United States Patent [19]

Walker, Sr.

[11] Patent Number: 4,588,045

[45] Date of Patent: May 13, 1986

[54] DESCENT CONTROL DEVICE

[76] Inventor: Roy D. Walker, Sr., 3518 Mitchell, St. Joseph, Mo. 64507

[21] Appl. No.: 668,334

[22] Filed: Nov. 5, 1984

[51] Int. Cl.[4] ..... A62B 1/14

[52] U.S. Cl. ..... 182/5; 182/191

[58] Field of Search ..... 182/5-7, 182/236, 237, 231, 239, 71, 190-192, 234, 240, 72; 188/65.1, 65.5

[56] References Cited

U.S. PATENT DOCUMENTS

| | | | |
|---|---|---|---|
| 409,511 | 8/1889 | Slaugh . | |
| 507,455 | 10/1893 | Sansoucy | 182/5 |
| 748,526 | 12/1903 | Petersen | 182/192 |
| 890,898 | 6/1908 | Gaillac | 182/191 |
| 2,323,883 | 7/1943 | Wiley . | |
| 3,532,189 | 10/1970 | Wade . | |
| 3,852,943 | 12/1974 | Healy | 182/5 |
| 4,019,609 | 4/1977 | Wagner | 182/5 |
| 4,027,748 | 7/1977 | Persson . | |
| 4,184,567 | 1/1980 | Rabelos . | |
| 4,399,889 | 8/1983 | Todd . | |
| 4,446,943 | 5/1984 | Murray . | |
| 4,448,281 | 5/1984 | Adams . | |
| 4,457,400 | 7/1984 | Donaldson . | |

FOREIGN PATENT DOCUMENTS

| | | | |
|---|---|---|---|
| 1927155 | 12/1977 | Fed. Rep. of Germany | 182/5 |
| 436713 | 6/1948 | Italy | 188/65.1 |
| 375210 | 6/1932 | United Kingdom | 182/5 |

OTHER PUBLICATIONS

Atlas Safety Equipment adver., "Descent-Master".
Descent Control, Inc., Sky Genie Descent Systems catalog.
Design International, HydraScape Ltd. article entitled "Fire Escape System", p. 34.
Design International, Fail Safe Descender article, p. 28.
Newspaper article on Safe-T-Scape device.
Newspaper article from St. Joseph, Mo., Gazette, Friday, Nov. 5, 1982.
Newspaper article on device called "The Evacuator".

*Primary Examiner*—Reinaldo P. Machado
*Assistant Examiner*—Alvin Chin-Shue
*Attorney, Agent, or Firm*—Litman, Day and McMahon

[57] ABSTRACT

A descent control device is provided for lowering a person, animal or object from a first position of height to a second position substantially lower, especially as during escape from fire. The device comprises an assembly of three interacting parts including a strap, a brake block, and a friction ring. The strap, brake block, and friction ring interact and cooperate causing frictional engagement among themselves when the device is assembled. The resulting friction is used to control the descent from the place of height. The device may be utilized in two modes of operation: in the first, a descender utilizes the brake block and friction ring to slide downward upon the substantially stationary strap; in the second, the strap is used to lower a person, animal or object by attaching same to one end of the strap and utilizing the brake block and friction ring as a brake to control the lowering of the strap. When the device is used in the second mode of operation, the descent is controlled by a party, not descending, who may be positioned at either the place of height, the place to which descent is being made, or elsewhere, under certain circumstances. A modification of the device is provided in which the friction ring is modified so that the amount of friction applied to the strap as it passes through the friction ring can be selectively increased. In a further modification of the device, the brake block is changed to facilitate descent.

7 Claims, 12 Drawing Figures

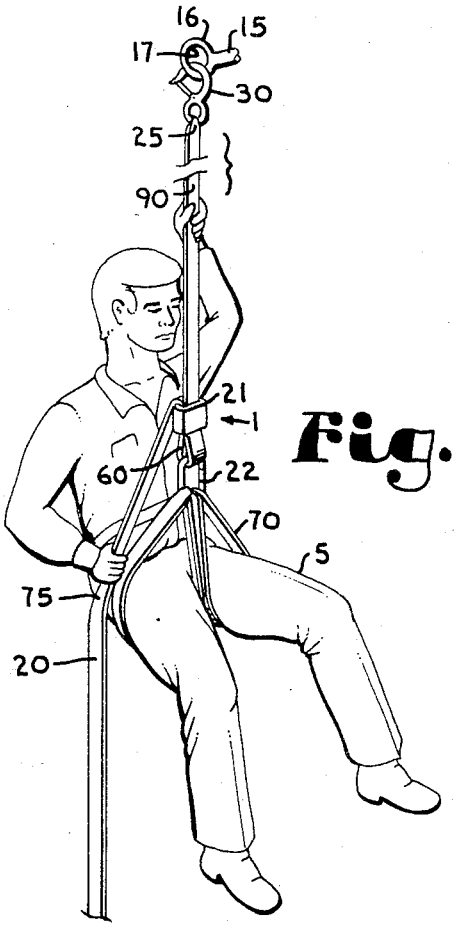
Fig. 1.
Fig. 2.
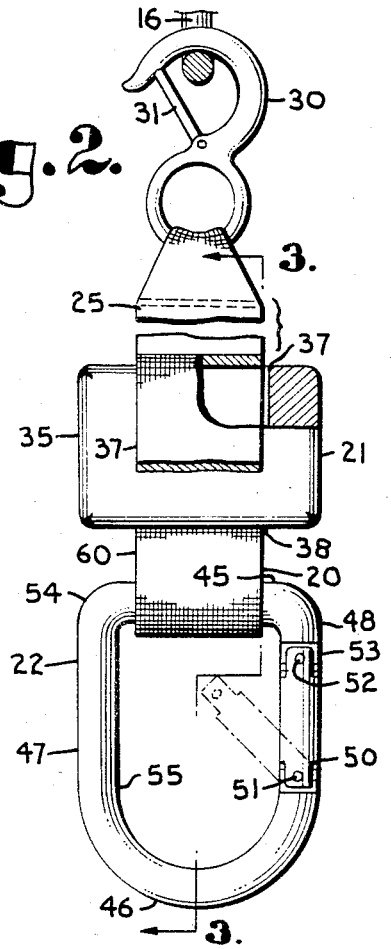
Fig. 3.
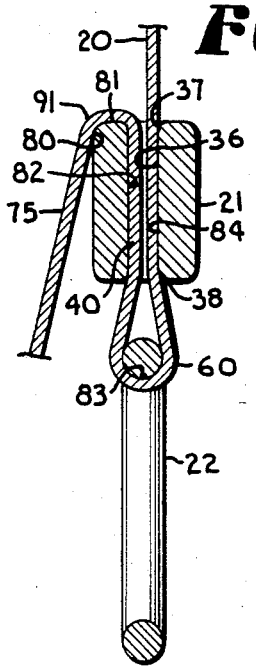
Fig. 9.
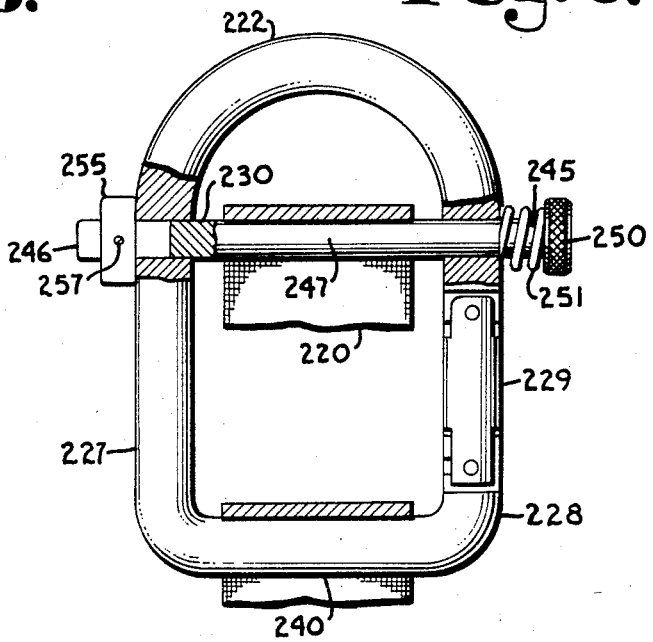

DESCENT CONTROL DEVICE

BACKGROUND OF THE INVENTION

The present invention relates to descent control devices and in particular to a device which is utilized to either allow a first person to lower another person, or object of great weight, from a place of height, in a controlled manner, or alternatively to allow a descender to lower himself or herself from a place of height.

Descent control devices, of various types, are well known and have been utilized as fire escape devices, as rappel devices for search and rescue teams, and as evacuation devices for leaving hovering aircraft such as helicopters. Although these devices have numerous designs, they are normally characterized by the following: (1) conventional devices are normally only easily utilizable by the person actually making the descent; and (2) rate of descent is normally controlled by the rate of movement of a brake along a rope or strap, the rope or strap being wrapped in a complex manner about the device so that resulting friction slows the rate of descent, with the amount of friction sometimes being adjustable.

Numerous problems have been associated with these conventional descent devices. First, they may be highly complex and difficult to set up in an emergency situation. Secondly, their complex nature may make them unusable without special training. Thirdly, when the device must be used repeatedly within a short period of time, such as during a fire, the conventional devices do not typically work well, since the device must be disattached from the end of the line, transferred to the beginning of the line, reattached to the line, and utilized again. Additionally, many of the devices are not sufficiently small and portable to be completely desirable as fire escape devices.

In the art of descent control devices, a primary consideration is safety. Preferred devices are those which are specifically designed to minimize jamming-up during operation, so that the person descending does not become stuck in mid-air part way through the descent, and so that the rate of descent can be easily controlled under almost every condition.

A major limitation to many conventional descent control devices, as eluded to above, is that they must be controlled by the person actually making the descent. Thus, objects, animals, invalids, unconscious persons and children often cannot be safely lowered by these devices. It is readily seen that a device which could be controlled by the person actually making the descent and alternatively which can also be controlled by another person, by making only a simple modification, for lowering an object, animal or other human descender, would be desirable.

With safety and emergency equipment, factors such as cost, portability, and size can become very important. If the equipment is too expensive, it will not typically be purchased, since consumers will often consider the probability of needing the equipment as being not worth the expense. Thus, when the emergency happens to them, they will have no proper equipment. If the device is not sufficiently portable, it cannot be rapidly moved to the location of use when needed. If the device is not suitably small, it might not be stored near those locations where it is most likely to be needed. It is readily seen that the more these features can be desirably improved, the better will be the descent control device.

Additionally, safety and emergency equipment should be relatively easy to use. During emergencies, the operator's attention is often divided between numerous concerns and rapid action is essential. Thus, the easier the equipment is to use, the higher the probability will be that it can serve its purpose. Additionally, the use of safety and emergency equipment is often only infrequently and insufficiently practiced. Therefore, the easier the equipment is to use, the more likely it will be that the user will remember its method of operation between uses. Further, it is best if one of ordinary intelligence can simply look at the equipment and figure out how to use it, having only seen the equipment in use once before or having never seen the equipment in use but rather only having had its use explained. Therefore, in this art, the more simple the device is or appears, the more desirable it may be as a descent control device. Thus, through a history of such devices, a trend toward simplifying improvements is observed.

OBJECTS OF THE INVENTION

Therefore, the objects of the present invention are: to provide a descent control device especially suited as an emergency descent device; to provide such a device which includes an elongate strap and a friction ring and brake block arrangement which may be mounted on the strap to allow descent of same, with a person attached thereto, with the rate of descent being easily controlled by the person making the descent; to provide such a device which may be alternatively used by an operator to lower a second person, object or animal, by utilization of the strap, friction ring and brake block; to provide such a device which is relatively simple to use so that its operation may be rapidly understood and easily retained; to provide such a device which is rapidly and easily deployed; to provide such a device which is rapidly and easily utilizable a number of times in rapid succession; to provide such a device which is easily transported; to provide such a device which is relatively small and easy to store; to provide such a device which is inexpensive to manufacture; to provide such a device which is relatively sure of trouble-free use; and, to provide such a device which is particularly well adapted for the proposed uses thereof.

Other objects and advantages of this invention will become apparent from the following description taken in conjunction with the accompanying drawings wherein are set forth, by way of illustration and example, certain embodiments of this invention.

SUMMARY OF THE INVENTION

A descent control device is provided for allowing a person to lower himself or herself from a position of height to a location substantially lower. In the alternative, the device may be utilized by an operator to lower another person or an object from a location of height to a substantially lower location with the operator controlling the rate of descent. Although it will be understood that the device may be used to lower a person, animal or object, it will normally be referred to herein as being used to lower a person. The assembly which comprises the device includes a strap for extending between the position of height and the lower location, a friction ring, and a brake block.

As described above, the descent control device has two modes of operation. In the first mode, a first location on the strap is attached to an anchor affixed substantially near the first location, i.e. the position from which descent is desired. In the case of a building, the anchor might be an eye attached to the wall of the building, with a safety hook being located on a first end of the strap. The strap is then lowered so that it hangs from the anchor and extends downwardly to the lower location. An advantage to the device is that, for the first mode, the strap need not be any longer than the length of descent.

The brake block comprises a solid, generally rectangular block having a generally rectangular longitudinal channel extending therethrough. The block is preferably composed of a material, such as metal, wood or plastic, which can withstand the forces of use and the friction of the strap passing therethrough without becoming harmfully hot and without harming the strap. When the assembly is prepared for use in the first mode, a portion of the strap located substantially adjacent the first end of the strap which is anchored to the first location is folded double to form a loop and the loop is inserted through the channel in the brake block. The result of the above is that a loop of strap extends from one end of the block and both free ends of the strap extend from the other end of the block. A friction ring is attached to the loop extending from the block which prevents the loop from being pulled back through the friction block channel.

The friction ring is a generally D-shaped ring having two opposite and parallel sides, a straight end, and a generally curved opposite end. A gate located in one of the sides of the friction ring facilitates attachment of the ring to the looped portion of the strap. The ring is sufficiently large so that it cannot pass through the channel in the block. Thus, after assembly, tension on the free end of the strap, that is, the end not anchored to the building, with concomitant sliding of the brake block, moves the friction ring substantially adjacent the block with only a small portion of the strap loop extending therebetween.

The above assembly creates numerous points of friction between the strap, the brake block, and the friction ring. Following from the anchor, as the strap first passes under the brake block, it frictionally engages an internal surface of the channel; it then emerges from the channel, as the loop portion, and engages the ring, again with a frictional contact; after it loops over the ring it passes back through the channel, again frictionally engaging an internal wall thereof and emerges from the channel to extend to the ground. The high degree of friction present in the assembly tends to prevent rapid and uncontrolled descent. It will be seen that the weight of the person descending actually aids in causing this friction, thus heavier persons actually tend to generate greater braking, which is what is usually needed.

In the first mode of operation, the person descending attaches himself to the friction ring. Typically, the descender wears a harness which is hooked to the friction ring either by means of the gate or by a separate hook. The person then grasps a portion of the strap extending below the brake block and allows himself to be suspended, by the strap, from the friction ring. The friction block and ring, along with the person, will slide downwardly along the strap with sequentially lower and lower portions of the strap entering the brake block, passing over the friction ring, reentering the brake block, and then emerging therefrom. As noted above, the high degree of friction helps prevent too rapid a descent. Further, the rate of descent can be controlled, by the descender, by placing tension on the lower end of the strap in a manner increasing the total amount of friction between the strap, brake block, and ring. If necessary, the descender, in most instances, can easily completely stop the descent.

Upon reaching the bottom of the descent, the descender disengages from the friction ring. A second descender, still located at the upper position, can easily prepare the equipment for reuse by simply pulling up the second end of the strap and attaching it to the anchor and disengaging the first end of the strap from the anchor and lowering it to the ground, thus inverting the device. This rapid invertability of the device is an advantage to use where rapid evacuation of more than one person from the upper location is necessary.

Alternatively, rapid evacuations by descent are possible by other descenders possessing brake blocks and friction rings, who attach themselves to the already suspended strap. It will also be understood that the descender may attach himself to the strap at any point below the first end. For example, if the strap was suspended from near the top of a building, and extended completely to the ground, persons on any of the lower floors could attach themselves to the strap with a friction ring and brake block and descend. In some instances, more than one person at a time might be descending a single strap.

In a second mode of operation, the device is utilized with the friction ring attached to the location of height from which the descent is to be made. In this mode of operation, the person to be lowered is attached to a hook on the strap. The strap extends from the person, through the brake block, over the friction ring, back through the brake block and into the grasp of a second person, not descending, who controls the rate of descent. The descender, attached to one end of the strap, is lowered by the person controlling the other end of the strap in a manner similar to use of a strap and pulley. However, the presence of the brake block, with both ends of the strap extending therethrough from one side, and a loop attached to the ring extending from the other, causes a great amount of friction to passage of the strap through the system and thus lowering of the person or object. This second mode of operation is primarily for utilization when what is being lowered is not capable of controlling its own descent and, therefore, cannot utilize the first mode of operation. Examples of such instances are when objects are to be lowered; when children, the aged, or invalids are being lowered; when unconscious or partially conscious persons are being lowered; and, when animals are being lowered. The person controlling the descent may be positioned either at the upper location, from which the descent is being made, or located at the lower point, to which the descent is being made. As will be seen from the detailed description, if the person controlling the descent in the second mode of operation is located at the point to which the descent is being made, the strap must be approximately twice as long as the distance of descent. It will also be seen that the position of the person controlling the descent, in the second mode of operation, can be varied considerably. Further, it will be understood that the hooks on the strap need not be located at the ends of the strap. If this is done, then a tail of strap material will extend between the end of the strap and the hook giving the person controlling the descent a tail of material to hold to control the descent. Instances in which this might be useful would be to have a tail of material extending between the person descending and the ground, so that their sway can be controlled or that obstacles can be cleared, or to have a tail of material extending between the second hook and the person controlling the descent, so that the second hook can be working its way up toward the block while the descender is coming down. For this type of operation the strap would normally be approximately four times the length of descent so that when the person is first beginning descent a tail of strap extends all the way to the bottom of the descent, a portion of the strap extends to the bottom at which a hook is located and a tail of strap extends from the unused hook to the end of the strap. Then when the person descends, the second hook will go toward the brake block and the person controlling descent will hold the second tail.

The second mode of descent may also be used a number of times in rapid succession. Once the first hook on the strap has been completely lowered, the second hook can be pulled up near the place from which descent is being made, and a second descender can be attached to the second hook. Descent will then be made by operation of the device in reverse to the method used for the first descender. Normally, the strap will be tailor made for the location of use so that excess strap material will not be present and greater speed and efficiency will be obtained.

In the second mode, a single strap can be rapidly utilized to facilitate descent of a large number of persons, by allowing the two hooks on the strap to alternately raise and lower. Also, if the descent is being controlled by a person located near the brake block and friction ring, once all others have descended safely, the controller can rapidly convert the device to the first mode and also descend. It will be understood that the easy convertibility of the device between the two modes is, potentially, a highly desirable feature.

It is noted that depending on whether the first mode of operation or the second mode of operation is utilized the strap remains stationary with the brake block and ring moving therealong; or, the ring and brake block remain relatively stationary with the strap sliding therethrough.

As is seen in the detailed description and the drawings, at least two variations may be made in the device to aid in its utility. The first involves a variation in the brake block in which spacers are mounted near the end of the channel from which the looped portion of the strap protrudes. These spacers serve to prevent the friction ring from too closely abutting the brake block and binding up the free flow of the strap through the brake block and friction ring. Such free-flow may be desired in circumstances where rapid descent is desired.

The second variable feature is the addition of a friction-causing cross-bar in the friction ring. When this cross-bar is utilized, the strap is wound an extra time about the friction ring, increasing the friction between the friction ring and the strap when the two move with respect to one another. This facilitates greater control and slower descent, and is particularly useful in the second mode of operation, especially with very heavy persons or objects.

The drawings constitute a part of this specification and include exemplary embodiments of the present invention and illustrate various objects and features thereof. In some instances, material thickness is shown exaggerated for purposes of clarification.

BRIEF DESCRIPTION OF THE DRAWINGS

FIG. 1 is a fragmentary perspective view of a descent control device according to the present invention, being shown as utilized by a descender, in a first mode of operation.

FIG. 2 is an enlarged, fragmentary, front elevation view of the descent control device shown in the first mode of operation, with portions broken away to show detail thereof and with alternative positions of certain parts shown in phantom.

FIG. 3 is an enlarged, fragmentary, side cross-sectional view of the descent control device, taken generally along line 3—3 of FIG. 2.

FIG. 9 is a fragmentary, front elevational view of the first modified descent control device with portions broken away to show detail thereof.

DETAILED DESCRIPTION OF THE PREFERRED EMBODIMENT

Figure 4:
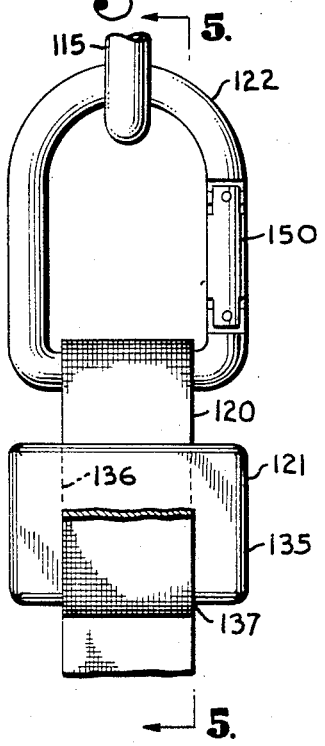
FIG. 4 is an enlarged, fragmentary, front elevational view of the descent control device, according to the present invention, shown in a second mode of operation.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a descent control device according to the present invention.

The descent control device 1 generally has two basic modes of operation. In a first mode of operation, as seen in FIGS. 1, 2 and 3, a descender 5 controls his or her own descent from a location of height (not shown) to a lower place (not shown). In a second mode of operation, shown in FIGS. 4, 5 and 6, a person 8 is lowered from a place of height (not shown) to a lower place (not shown) with the descent and rate of descent being controlled by a second person 9. The second person 9 may be located either at the place of height, or at the place to which the descent is being made, or under some circumstances, at a third location. The second mode of operation, see especially FIG. 6, is readily adaptable to the lowering of objects and animals, as well as persons. For ease of description, the first mode of operation, FIG. 1, is described below in its entirety before the second mode of operation, FIG. 6 is discussed.

Referring to FIGS. 1, 2 and 3, a descender 5 is shown suspended between a place of height (not shown) and a place to which descent is intended (not shown). In a typical instance, the descender 5 will be descending from the window of a building (not shown) near which an anchor 15 is located. However, the descent control device 1 may be utilized to make a descent between nearly any two positions distinguished by vertical height, including a portion of a building and the ground, and between a hovering aircraft, such as a helicopter, and the ground. The device 1 is normally utilized in cooperation with the anchor 15, which is shown as a hook 16, having an eye 17 therethrough. The anchor 15 is to be securely affixed near or above the place from which descent is to be made and is generally within easy access of the descender 5.

The descent control device 1 includes an elongate strap 20, a brake block 21 and a friction ring 22. The elongate strap 20 includes two ends, only one end 25 of which is shown in FIG. 1. An attachment member comprising a safety hook 30, FIG. 2, is attached to a first strap location on the first end 25 of the strap 20. While a variety of hooks 30 may be utilized, the one shown includes a gate 31 which permits easy attachment of the hook 30 to the anchor 15 but which prevents unintended disengagement of the hook 30 from the anchor 15. Alternatively, a hook might be attached to the building, and an eye might be mounted in the strap 20. It will be understood that the attachment members comprising a hook 30 need not be attached to the first end 25 of the strap 20 but rather can be positioned on the strap 20 at a first strap location spaced apart from the first end 25. This configuration might be utilized if a utility tail of strap material is desired between the hook 30 and the end 25 of the strap 20.

As will be seen from the description below, it is preferred that a second hook (not shown) is attached to the second end of the elongate strap 20. Such an arrangement is shown in the second mode of operation of the assembly depicted in FIG. 6. As with the first safety hook 30, it will be understood that the second hook need not be positioned on the second end of the strap 20, but rather may be located at a second strap location spaced apart from the second end of the strap 20. Such an arrangement would be desired if a second utility tail, not shown, is needed.

Referring again to FIG. 1, the descender 5 makes the descent from a position near the ring 15 by sliding down the elongate strap 20 and controlling the descent by gripping the elongate strap 20 and utilizing friction control provided by the descent control assembly 1. The manner in which the descent control assembly 1 generates the appropriate friction to control the rate of descent will become apparent from the below description of the parts, which make up the device 1, and their interaction.

Referring to FIGS. 2 and 3, the elongate strap 20 is a long, flexible, strap, possessing sufficient strength to safely carry the weight of the person, persons, or object descending, and also possessing sufficient resistance to heat to not be significantly weakened by the large amount of heat which will be generated near the strap surface by passage through the brake block 21 and the friction ring 22. A particularly useful material for the elongate strap 20 is a tightly woven web made from a synthetic fiber such as nylon. Such webs are relatively inexpensive, are light and strong, and can be easily rolled-up for storage when not in use. The strap 20 is preferably of rectangular cross section, and thus, is long and flat. With this configuration, the strap 20 may be rapidly unrolled, with minimal tangling, when needed. Additionally, as will be seen from the below description, the large surface area associated with a flat strap 20 may increase the amount of available frictional engagement between the strap 20 and the rest of the device 1, thus facilitating descent control.

The brake block 21 is a generally rectangular block 35 having a generally rectangular channel 36 extending completely therethrough. The channel has a first end 37 and a second end 38. In its widest dimension, FIG. 2, the channel is sufficiently wide to permit passage of the elongate strap 20 therethrough. In its narrowest dimension, FIG. 3, the rectangular channel 36 is sufficiently wide to permit a double overlapping portion 40 of the elongate strap to pass therethrough. The rectangular block 35 is preferably molded from very strong material, such as a plastic or metal, which can easily withstand the forces and heat of use.

The friction ring 22, FIG. 2, is a generally D-shaped ring of metal having a flat top portion 45, a curved bottom portion 46, a first side 47 and a second side 48. A gate 50 is positioned in the second side 48 to permit the ring 22 to be opened for engagement with hooks or eyes, other rings, or the strap 20. The gate 50 comprises a portion of the second side 48 and is pivotally mounted therein by an axle 51 which extends through the second side 48. The gate 50 includes a cross-bar 52 which engages a support 53 of the first side 48 to strengthen the ring 22 when the gate 50 is closed.

The friction ring 22 then, has an outer circumferential portion 54 defining an internal volume 55. As stated above, the friction ring 22 is preferably made from a metal or metal alloy, but it may also be made of any material sufficiently strong to withstand stress and the heat forces likely to be encountered by operation of the device. Further, as will be seen below, a variety of shapes of friction rings may be utilized according to the present invention; however, all such friction rings will have in common the characteristic that the top side 45 is sufficiently large to prevent the ring 22 from passing through the brake block channel 36.

In FIGS. 1, 2 and 3, cooperation of the elongate strap 20, the ring block 21 and the friction ring 22, which enables the descender 5 to control his rate of descent, is illustrated. In assembling the device 1, a portion 40 of the elongate strap 20 is folded double and inserted through the rectangular channel 36 in the brake block 21, with a looped portion 60 protruding from the rectangular channel second end 38. Next, the friction ring 22, by means of operation of the gate 50, is attached to the strap loop 60, FIG. 2.

In preparation for a descent from a position located substantially near the anchor 15, the looped portion 60 is made substantially near the end 25 of the strap 20 which is attached to the anchor 15; and the brake block 21 and ring 22 are mounted on the strap 20 at that position. The descender 5 then attaches himself to the friction ring 22, FIG. 1. In FIG. 1, the descender 5 is shown wearing a diaper harness or sling 70 which is attached to the friction ring 22. The harness or sling 70 may be of a variety of designs and preferaby is such that a safe, secure, attachment of the descender 5 to the friction ring 22 is facilitated thereby. It will be understood that if the attachment member, comprising a safety hook 30, is not mounted on the end 25 of the strap 20, then the loop 60 should be formed between the attachment member and the second end of the strap 20.

If the descender 5, now suspended from the loop 60 by the friction ring 22, suspends himself from the anchor 15, FIG. 1, and tightly grips the strap 20 at a location 75 beneath the brake block 21, he can generally prevent himself from descending, and maintain a static position suspended from the anchor 15. By 37 beneath the brake block" it is meant that the strap 20 is gripped at a position between the brake block 21 and the end of the strap 20 toward which descent is being made.

As the descender 5 tends to loosen his grip on the portion 75 of the strap 20 below the brake block 21, the descender's weight will tend to cause the strap 20 to slip through the brake block 21 and friction ring 22, allowing the descender 5 to be lowered. The actual cooperation of the parts of the device 1, in the first mode of operation, comprises the strap 20 remaining essentially stationary and the brake block 21 and friction ring 22 sliding therealong. Referring to FIG. 3, this cooperation generates numerous points of friction within the device 1. These generally include: point 80 where the lower part 75 of the strap 20 first encounters the brake block 21; the entire upper surface 81 of the portion of the brake block 21 over which the strap 20 passes before it enters the channel 36; the entire inner surface 82 of the channel 36, against which the lower portion of the strap 20 passes before it emerges to form the loop 60; the surface 83 of the ring 22 against which the loop portion 60 rests; and, the inner portion 84 of the channel 36 against which the strap 20 rests before it emerges from the upper end 37 of the channel 36 on its way to the upper end 25. Additionally, if strong downward pressure is placed on the portion 75 of the strap 20 extending beneath the brake block 21, that is, a diverging tension between the two ends of the strap 20, the brake block 21 will tend to be pushed against the friction ring 22, tending to bite the strap 21 therebetween, causing further friction. This bite is facilitated by the configuration of the flat strap 20 cooperating with the brake block 21 and the ring 22, FIGS. 2 and 3.

The top end 45 of the ring 22 is aligned perpendicular to the elongate strap 20. Additionally, since a wide, flat strap 20 is used, the top end 45 is parallel to the wider faces of the channel 36. Because of this, the flat strap 20 can be caught between the long, top end 45 of the ring 22 and the brake block 21. Since the strap is wide, this "bite" can occur over a substantial surface area of the strap 20, so that movement of the brake block 21 and ring 22 relative to the strap 20 is relatively easily controlled. Additionally, the large surface area of a wide strap 20 may aid in increasing frictional engagement between the strap 20 and other parts of the device 1. Also, if necessary, a narrow width of the channel 36 can be chosen to cause the strap 20 to rub against itself as it passes therethrough, further increasing friction. It is foreseen that the width of the channel 36 may be made adjustable by means (not shown) so that this latter component of friction may be increased or decreased as desired. Such a means could conceivably be an adjustable press (not shown), similar to a vise, which is selectively widened or narrowed.

The effect of the friction generated between the strap 20, the brake block 21 and the friction ring 22 is to prevent the brake block 21 and the friction ring 22 from being able to slide down the strap 20 very rapidly, even when a large weight is suspended from the ring 22. It has been found that the amount of friction, or resistance to sliding, is sufficient so that the descent can be generally easily controlled by the descender 5 gripping the portion 75 of the strap 20 below the brake block 21. The descender may further grip the portion of the strap 90 above the brake block 22 for stability. Should the descender 5 desire to completely stop the descent, the friction is generally sufficient to permit him to do so by simply tightly gripping the strap 20. Should the descender 5, in the alternative, desire to quicken the descent, generally this can be done by lifting up on a portion 91 of the strap 20 near the end 37 of the channel 36, thus reducing the frictional contact between a strap 20 and point 80, and surface 81.

Once the descender 5 has completed the descent, disconnection from the device 1 is accomplished by opening the gate 50 in the friction ring 22 and detaching it from the sling 70. The device 1 can then be disassembled by again opening the gate 50 and detaching the ring 22 from the loop 60, and then pulling the loop 60 through the channel 36.

If it is necessary for a second descender (not shown) to descend from the same place of height (not shown) utilizing the same strap 20, the device 1 can be easily prepared for the second use in the following manner. If a second safety hook (not shown in FIG. 1) is attached to the second end of the strap 20, preparation for the second descender may be made by leaving the brake block 21 and friction ring 22 attached to the strap 20 after the first descender 5 completes the descent. Then, the next descender, still located at the place of height, can pull up on the strap 20 to bring the second end of the strap 20 up near the anchor 15. If the first end 25 of the strap 20 is now disengaged from the anchor 15, by removal of the hook 30 therefrom, and the second end of the strap 20, having a similar hook, is attached to the anchor 15, the device 1 is now substantially ready for the second descent. That is, the second end of the strap simply replaces the first and the brake block 21 and friction ring 22 are now located near the upper end, which is now the second end of the strap 20, for ready access and engagement by the second descender. In this manner, the device 1 is particularly adapted for use in situations where rapidly repeating evacuations from high places are necessary, with numerous persons utilizing a single descent control device 1. This rapid inversion assumes that the assembly 1 is left near the second end of the strap 20 after the first descent.

Once a strap 20 has been placed in position for descent, numerous persons may rapidly descend if each possesses a brake block 21 and ring 22. It is even foreseen that under certain circumstances more than one descender may utilize a single strap 20 at a given time. Also, although the device 1 has been described as being utilized by a descender 5 who attaches the strap 20 to the anchor 15, it is foreseen that the strap 20 may be already in place before the situation necessitating the descent. Also, the descent may be made by engaging the strap 20 at any point along its descending length. For example, the strap 20 may be anchored to the top of a ten story building with the descender engaging the strap at the fifth floor.

It will be generally understood that the more rapid the descent, the greater the amount of heat that will be generated by the passage of the strap 20 through the brake block 21 and the friction ring 22. The materials from which these components are manufactured should be selected to accommodate this heat with an extra margin for safety. Additionally, it will be understood that the strength of the materials from which the strap 20, the brake lock 21, and the friction ring 22 are chosen is important to ensure the safety of the descender 5.

It is anticipated that the brake block 21 will normally be a single piece of material cast in a mold. However, it is foreseen that if the manufacturer is concerned with the possibility of a flaw in the molded material, from any given single molding, the brake block could comprise two separate pieces of material, each having a channel therethrough, which are aligned with their channels positioned coaxially and which are utilized in sequence on the strap. Since it is unlikely that both molded blocks would have the same flaw, if one breaks the other should prevent catastrophy.

It will be understood that under certain circumstances a brake, not shown, may be desired to enable the person making the descent to completely stop the descent and be suspended by the strap 20. Such a brake may be provided by a vise grip or similar arrangement located within the brake block 21 enabling the descender to adjust the width of the channel 36 in the block 21. If the channel 36 is adjusted to a sufficiently small size, the strap will be prevented from being able to move therethrough and descent will be halted. Readjustment of the brake would permit descent to continue. If such a brake is appropriately adjusted it may be used to only slow descent rather than completely stop it.

As referred to above, the descent control device 1 has a second mode of operation. This mode of operation is illustrated in FIG. 6. It is to be understood that the second mode of operation can be conducted with the very same strap, brake block, and friction ring which are utilized for the first mode of operation. In fact, one major advantage to the device 1 is its rapid convertibility between the two modes. However, for purposes of clarity, different reference numerals will be utilized for these parts in FIGS. 4, 5 and 6 to illustrate the second mode of operation. In FIG. 6, descent is being made, by means of the device 100, from an upper position near an anchor 115. Referring to FIG. 6, the descent control device 100 includes a strap 120, a brake block 121, and a friction ring 122.

The strap 120 has a first end 125 and a second end 126. To facilitate rapid re-use of the device 100, analogous to that described for the first mode of operation, attachment members or safety hooks 130 and 131 are attached to both ends 125 and 126 of the strap 120. It will be understood that the safety hooks 130 and 131 need not be attached to strap locations on the ends, 125 and 126, of the strap 120, but rather could be positioned, respectively, at a first strap location and a second strap location spaced apart from the ends, 125 and 126, of the strap 120. Such an arrangement would be desired if a utility tail, not shown, is desired between the safety hooks, 130 and 131, and the ends of the strap, 125 and 126. In the second mode, such utility tails might be utilized to stabilize and control the direction of descent of the one descending, or, to provide an extension past the second hook 131, giving the person controlling the descent a tail of strap material to hold on to while the second hook 131 makes the ascent toward the place from which descent is being made, FIG. 6.

Figure 5:
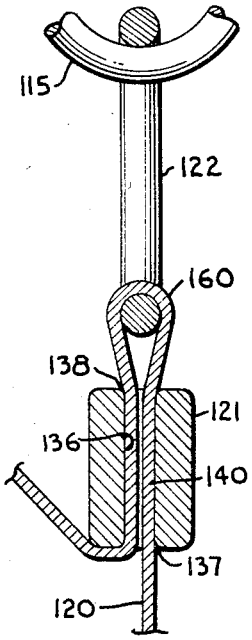
FIG. 5 is an enlarged, fragmentary, side cross-sectional view of the descent control device shown in the second mode of operation, taken generally along line 5—5 of FIG. 4.
Figure 6:
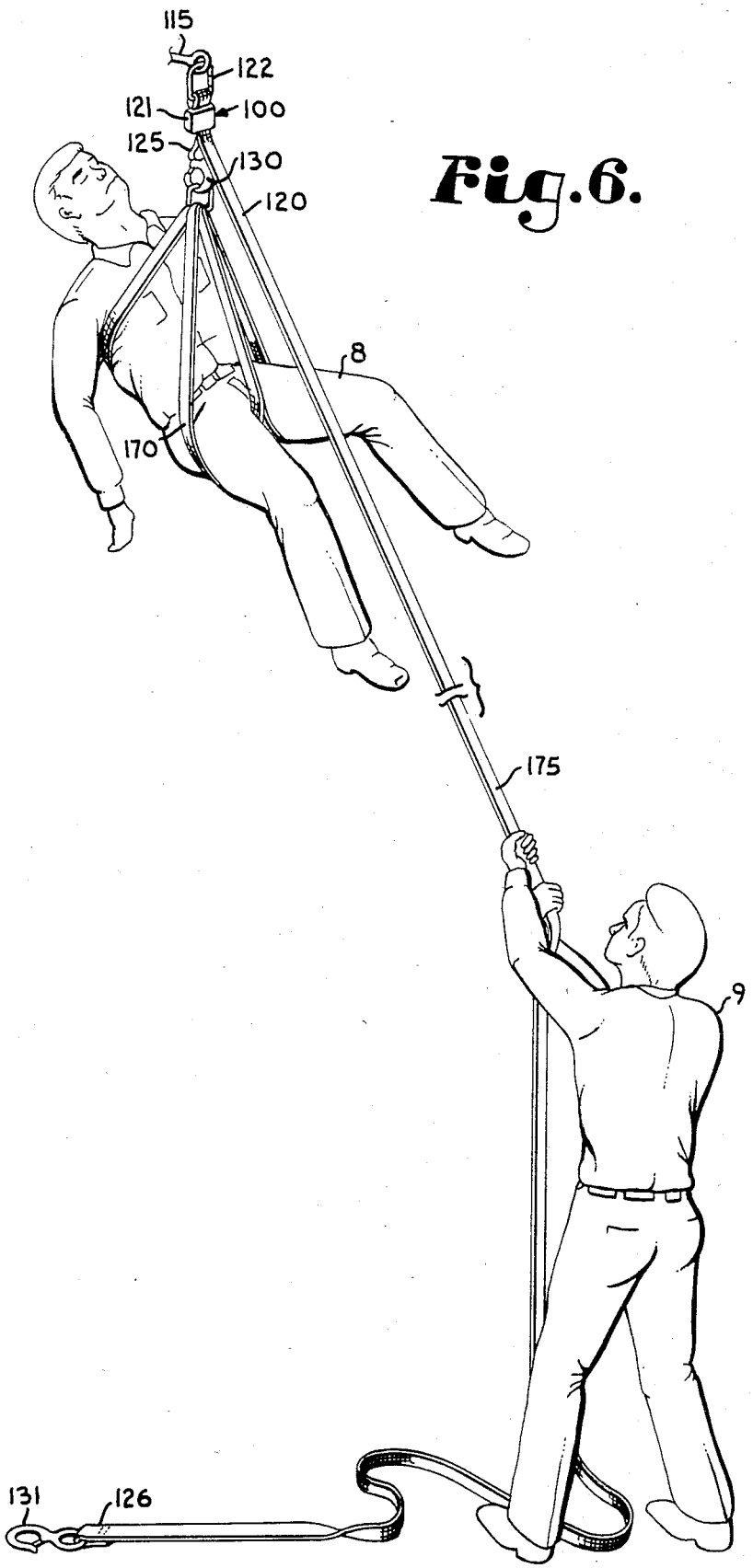
FIG. 6 is a fragmentary, perspective view of the descent control device utilized in a second mode of operation.

Since each component of the device 100 may be identical to those described for use in the first mode of operation, the brake block 121 is a generally rectangular block 135 having a rectangular channel 136 extending therethrough with a first end 137 and a second end 138, FIGS. 4 and 5. The channel 136 is appropriately sized to receive a double portion 140 of the strap 120 therethrough.

As described above for the first mode of operation, the friction ring 122 includes a gate 150 therein. The gate may be opened as necessary to connect the friction ring 122 to the strap 120, or other items. In preparation for use in the second mode, the descent control device 100 is assembled as follows:

A looped portion 160 is formed in the strap 120 by bending a portion of the strap 140 double. It will be understood that if the attachment members or hooks 130 and 131 are not located on the ends 125 and 126 of the strap 120, then the looped portion 160 should be formed between the two attachment members located at the first and second strap locations respectively. The looped portion 160 is inserted through the channel 136 so that the looped portion 160 extends from the second end 138 and the two ends 125 and 126 extend from the first end 137 of the brake block 121, FIG. 5. The friction ring 122 is then attached to the looped portion 160 by operation of the gate 150. The friction ring 122 is then attached to the anchor 115 also by means of the gate 150. The device 100 is now suspended from the anchor 115 and is prepared for use, FIG. 6.

The person 8, to be lowered, is placed in a harness or sling 170 which is attached to the safety hook 130. As shown in FIG. 6, the person 8 may now be suspended from the anchor 115 and supported by the assembly 100. The descent of the person 8 is controlled by a second person 9 gripping a portion 175 of the strap 120 located on the opposite side of the friction ring 122 from the person 8 to be lowered. The strap 120 and friction ring 122 may now be used analogously to a rope and pulley in order to lower the person 8, with the major difference between the use of the device 100 and a rope and pulley, being that the friction generated by the strap 120, brake block 121 and friction ring 122 cooperation is generally sufficient to provide for very easy control of the rate of descent. Points of friction which provide for this control are analogous to those described in the first mode of operation, with the primary difference between the first mode of operation and the second mode of operation being that in the first mode, the block and friction ring move downwardly along the strap and in the second mode the block and friction ring remain relatively stationary with the strap sliding therethrough. As with the first mode, the use of a relatively wide strap 120 in cooperation with parallel alignment between the friction ring 122 and the wider portion of the channel 137 of the brake block 121, facilitates control of the descent.

It is easily seen from the drawings, especially FIG. 6, that the second mode of operation is particularly useful for lowering persons who cannot themselves control their descent, such as children, invalids, elderly persons or unconscious or partially conscious persons. Additionally, the second mode may be utilized to lower objects or animals. Further, it will be understood that the person 9 controlling the descent of the person 8, may be located at either the position to which the lowering is being made or at the place of height from which the descent is being made, or if necessary, at a variety of other positions. The primary limiting factor is that they should be able to reach the strap 120 and the strap 120 must be sufficiently long to accommodate the controller's position. It will be understood that if the person 9 controlling the descent is located at the place to which the descent is being made, the strap 120 should be approximately twice as long as the distance of descent. Further, it will be understood that the preferred method of operation of the second mode is with the person controlling the descent being located above the descender, so that the strap 120 will pull against the brake block 121 to keep it substantially near the friction ring 122. If the person controlling the descent is located below the descender then the person controlling the descent should pull the strap 120 away from directly beneath the descender so the brake block 121 will tend to be prevented from sliding down the doubled strap 120 and away from the friction ring 122. Proper use is shown in FIG. 6.

When the second mode of operation is utilized, a second descent may be easily made in rapid sequence. Referring to FIG. 6, after the person 8 has been completely lowered, the second end 126 of the strap 120 may be moved to a position substantially near the brake block 121, and the friction ring 122, by continually pulling downward on a portion of the strap between the first end 125 of the strap 120 and the brake block 121, until the strap 120 is passed substantially completely through the brake block and the safety hook 131 is positioned near the friction ring 122. After this is done, the second person (not shown) to be lowered may be easily attached to the hook 131 by a sling or harness analogous to harness 170.

FIGS. 7, 8, 9 and 10 illustrate an alternate embodiment of a descent control device generally designated by the reference numeral 200.

Figure 8:
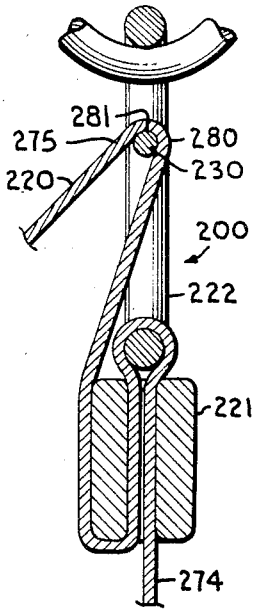
FIG. 8 is a fragmentary, side, cross-sectional view of the first modified descent control device taken generally along line 8—8 of FIG. 7.
Figure 7:
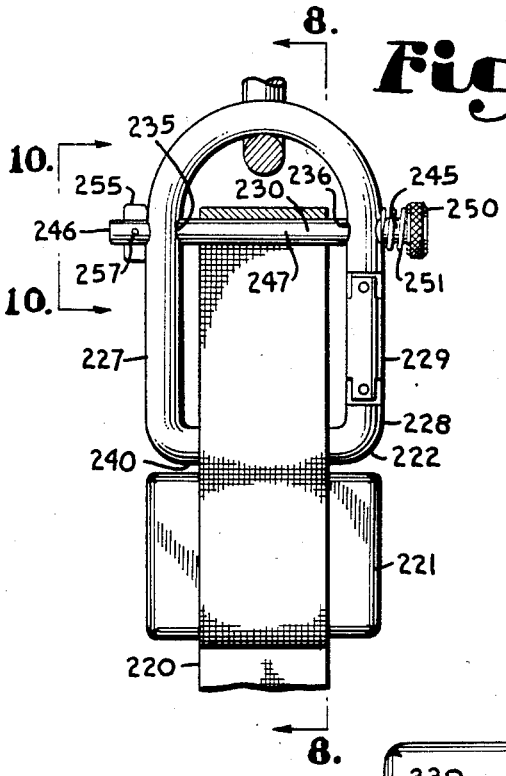
FIG. 7 is a fragmentary, front elevational view of a first modified descent control device according to the present invention.
Figure 10:
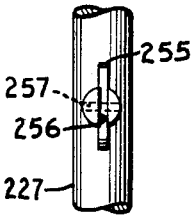
FIG. 10 is a fragmentary, side elevational view of the first modified descent control device taken along line 10—10 in FIG. 7.

Referring to FIG. 8, the device 200 comprises a strap 220, a brake block 221 and a friction ring 222. The strap 220 and brake block 221 may be identical to the strap and brake block described in the previous embodiment. That is, the only modifications necessarily made in the device 200 over the earlier described embodiment are made in the friction ring 222.

For the present embodiment, the friction ring 222 has slightly longer sides 227 and 228 than does the friction ring 22. The friction ring 222 does include a gate 229 for easy attachment of the friction ring 222 to either a loop in the strap 220 or other objects.

The primary difference between the friction ring 222 of the present embodiment and the earlier described ring 22 is the presence of a pin 230 positioned between the sides 227 and 228 of the ring 222. The pin 230 extends between and through bores 235 and 236 respectively positioned in the opposite sides 227 and 228 of the ring 222. The pin 230 is preferably mounted in the ring 222 in an orientation substantially parallel to a flat end 240 of the ring 222.

The pin 230 has a first end 245, a second end 246 and a central portion 247. The first end 245 has a head 250 thereon and a spring 251 retained thereon by the head 250. The second end 246 of the pin 230 has key-lock 255 pivotally mounted in a slot 256 by an axle 257. The key 255 should be substantially longer than the diameter of the bore 235. As is readily seen from examination of FIG. 7, the pin 230 is easily mounted within the ring 222 by rotation of the key 255 into longitudinal alignment with the central portion 247 of the pin 230 and extension of the pin 230 first through bore 236 and then through bore 235. Following the extension of the pin 230 through the ring 222, pressure should be maintained on the head 250 compressing the spring 251 and pushing the second end 246 of the pin 230 far enough out from the side 227 of the ring 222 to permit the key 255 to be pivoted about the axle 257 into the position shown in FIG. 10. If pressure is then released from the head 250, the spring 251 will bias the head 250 away from side 228 to press the key 255 against the side 227, anchoring the pin 230 within the ring 232.

As is seen by reference to FIGS. 8 and 9, the pin 230 may be utilized to place extra friction between the friction ring 222 and the strap 220 to aid in control of the descent.

In FIG. 8, the modified device 200 is shown being utilized in a manner analogous to the second mode of operation described above for device 100. The person to be lowered, not shown, is suspended from a portion of the strap 220 indicated by reference numeral 274. The person controlling the descent grips the strap 220 at a portion thereof generally referred to by reference numeral 275. Unlike for the device 100, in utilization of assembly 200, the portion 275 of the strap 220 is passed over the pin 230 before the person (not shown) who controls the descent grips it. The strap 220 may be easily wrapped over the pin 230 by having a portion 280 thereof pushed through the ring 222 before the pin 230 is inserted therein. Then, once the pin 230 is mounted within the ring 222, a loop 280 in the strap 220 will pass over the pin 230 and thus create an additional surface 281 of frictional contact between the strap 220 and the ring 222. This additional surface friction 281 may aid in the control of the descent of the person or object by the party controlling descent.

It is foreseen, but not illustrated in the drawings, that the friction ring 222 including the pin 230 therein, may be utilized in a manner analogous to that described as the first mode of operation for the device 1. In this mode, the additional friction generated by the contact between the pin 230 and the strap 220 will aid persons making the descent to control their own descent.

Figure 11:
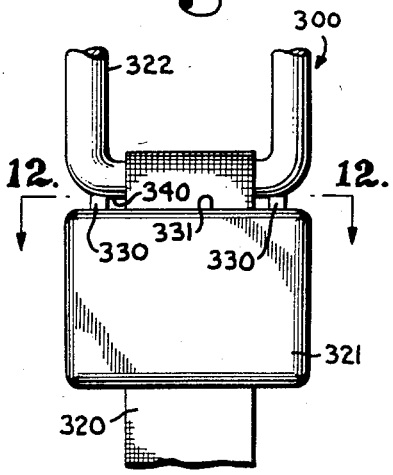
FIG. 11 is a fragmentary front elevational view of a second modified descent control device according to the present invention.
Figure 12:
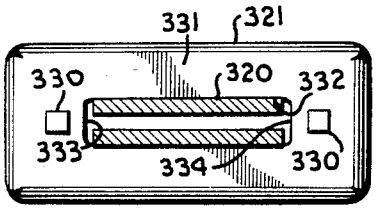
FIG. 12 is an enlarged top cross-sectional view of the second modified descent control device taken along line 12—12 of FIG. 11.

A second modified descent control device 300 is illustrated in FIGS. 11 and 12. Referring to FIG. 11, the device 300 includes an elongate strap 320, a brake block 321 and a friction ring 322. The elongate strap 320 and the friction ring 322 utilized with the second modified device 300 may be essentially identical to the strap 120 and the friction ring 122 described above for the second mode of operation. That is, the only necessary modification made in the device 100 to provide the device 300 is made in the brake block 321.

The brake block 321 is similar to the brake block 121 described above, except for the addition of spacers 330 mounted thereon. The spacers 330 are preferably formed as an integral portion of the brake block 321, that is, for example, when the brake block 321 is molded. The spacers 330 are positioned on a surface 331 of the brake block 321 which faces the friction ring 322 during assembly of the device 300.

As with the other brake blocks described above, brake block 321 includes a rectangular channel 332 passing completely therethrough. The spacers 330 are positioned slightly apart from opposite sides 333 and 334 of the channel 332.

During assembly of the device 300, FIG. 11, the spacers 330 will prevent the friction ring 332 from coming into too close a proximity to the surface 331 of the brake block 321. The gap 340 between the friction ring 322 and the surface 331 which is maintained by the spacers 330 will aid in permitting free flow of the strap 320 through the brake block 321 and friction ring 322. That is, the spacers 330 will prevent the strap 320 from becoming pinched between the friction ring 322 and the brake block 321. This should tend to aid in smooth operation of the assembly 300 and is particularly useful when light loads are lowered or when the person descending wishes to do so very quickly.

It will be understood that the spacers 330 may be utilized in conjunction with device 300 in either a use analogous to the first mode of operation or the second mode of operation. Further, spacers 330 such as those described for the device 300 may be utilized in conjunction with a friction ring having a pin therein, such as a device 200, to yield a further modified assembly (not shown). Also, the two component brake block described above, that is, a brake block which comprises two blocks having channels therethrough aligned in sequence but molded separately for safety, may be constructed according to the modification of FIG. 11 and 12, that is with spacers thereon. Also, such a two component brake block may be utilized with a friction ring modified according to device 200. Finally, if a brake block is chosen which has two identical ends, except for the location of spacers on one of the ends, the brake block may be invertible. Thus, the end with the spacers thereon faces the friction ring when rapid descent is desired and the end without the spacers may be faced toward the friction ring when more control, due to a possible "bite", is desired.

It is visualized that the descent control assembly may be used for descent, under certain circumstances, where the strap is shorter than the complete distance of descent. A manner in which this may be achieved is to provide a series of intermediate ledges along the descending route to which the descender can lower himself. Then, if the device is utilized in a manner similar to the first mode except with the strap passing over an anchor bar, tree limb or the like, not shown, located near the place from which descent is being made, complete descent can be made via a series of shorter descents. In this mode the strap is not anchored but rather the descender is attached to the friction ring; and the strap, above the descender, would pass through the brake bar over the anchor bar and then be attached to the friction ring. The descender would lower himself with the second end of the strap passing through the brake block, over the friction ring, back through the brake block and over the anchor bar. Thus, when the descender reaches the first ledge he can stop, completely disengage the descent control assembly from the first anchor bar by unhooking one end of the strap from himself and pulling the strap over the anchor bar, reengage the strap over a second anchor bar located at or near the intermittent ledge and continue descent.

The above detailed description and the accompanying drawings illustrate certain important features of the invention. First, the brake block, friction ring and strap cooperate in a manner such that they cannot easily become disassembled without either intentionally opening the gate and disconnecting the friction ring from the strap, or having a failure of one of the components, i.e. a breaking of the brake block, friction ring or strap. This cooperation tends to decrease the risks inherent with the use of any descent control device.

Additionally, as is seen from the drawings, the device is remarkably easy to assemble, for either mode of operation. Thus, it can be learned quickly and used effectively under emergency conditions.

It is also shown that the device is versatile in that it may used in the two modes described and may be rapidly used for a second successive descent.

It is to be understood that while certain forms of the present invention have been illustrated and described herein, it is not to be limited to the specific forms or arrangement of parts described and shown.

What is claimed and desired to be secured by Letters Patent is as follows:

1. A descent control device for lowering a person from a first location, at a place of significant height, to a second location substantially lower; said descent control device comprising:

(a) an elongate strap having a first end and a second end;
  (i) said strap being a substantially flat, thin, elongate strap of rectangular cross-section with first and second opposite sides and first and second edges;
  (ii) said strap being foldable therealong, and folded, so as to define a strap loop;

(b) a first attachment member mounted on said strap at a first location along said strap;
  (i) said first attachment member being a first member of hook and eye means;

(c) a brake block having a channel passing therethrough;
  (i) said brake block channel being substantially rectangular in cross-section with a wide dimension and a narrow dimension defining first and second opposite, wide inner surfaces;
  (ii) said channel having a first end and a second end and being sufficiently large to permit a doubled portion of said strap to pass therethrough, with said strap first side being generally parallel to, and in overlapping alignment with, said channel wide inner surfaces;
  (iii) said strap loop being formed in said strap between said first strap location and said strap second end, said loop being extended through said channel so that said loop extends outwardly from said first end of said block channel and so that said first and second ends of said strap extend from said second end of said block channel with said strap first side facing, and generally overlapping, said block channel wide inner surfaces as said strap twice passes through said channel;

(d) a friction ring in engagement with said loop;
  (i) said ring having two oppositely spaced sidewalls, and top and bottom oppositely spaced endwalls having a diameter larger than said narrow dimension; said top-end wall being elongate and substantially longer than said brake block channel is wide in its widest dimension;
  (ii) said friction ring being mounted on said strap loop with said strap passing therethrough and with said ring top end aligned generally along said brake block channel wide dimension, so that diverging tension on said first and second ends of said strap tends to pull said ring and said block toward one another and generally frictionally contact and bite a portion of said strap therebetween;
  (iii) said ring having gate means associated therewith facilitating mounting said ring on, or dismounting said ring from, said loop;

(e) whereby said strap may be trapped between said ring top end and said brake block along said block channel first end, and further, said strap being trapped by said ring top end extending in a direction generally laterally across said channel wide dimension; and, (f) whereby, for a first mode of operation, said device is prepared for use by: anchoring said strap first location near said place of height and extending said strap second end downwardly therefrom; and, sliding said block and ring along said strap to a position accessible by said descending person; and in use in said first mode: said person to be lowered is secured to said ring; and, said person slides down said strap by said ring, the rate of descent being controlled by forces tending to generate friction between said strap and each of said ring and said block; and (g) whereby, for a second mode of operation; said assembly is preapred for use: by attaching said ring to said place of height, by sliding said block into a position substantially near said ring and by adjusting said strap to have said first attachment member accessible to said descending person; and in use in said second mode, said person to be lowered is secured to said first attachment member and lowered thereby, with the rate of descent being controlled by forces tending to cause frictional interaction among said strap, said block and said ring, said friction permitting controlled movement of said strap through said ring by a second person.

2. The descent control device according to claim 1 including:

(a) spacers mounted about said second end of said brake block channel;

(i) said brake block being invertible, by removing said ring from said loop, inverting said block, and replacing said ring, to said block channel second end in place of said block channel first end; and, (ii) said spacers, upon inversion of said brake block, selectively preventing an extensive biting, abutting, engagement between said ring and said block;

(b) whereby said device is selectively usable for relatively rapid descent, with said brake block inverted, and for slower, more controlled descent, with said brake block in a non-inverted position.

3. The descent control device according to claim 1 wherein:

(a) said brake block comprises two separate blocks, each having a channel therethrough; said blocks being aligned in sequence with said channels coaxially aligned.

4. A descent control device for lowering a person from a first location, at a place of significant height, to a second location substantially lower; said descent control device comprising:

(a) an elongated strap having a first end and a second end;

(i) said strap being a substantially flat, thin, elongate strap of rectangular cross-section with first and second opposite sides and first and second edges;

(ii) said strap being foldable therealong, and folded, so as to define a strap loop;

(b) a first safety hook attached to said first end of said strap;

(c) a second safety hook attached to said second end of said strap;

(d) a brake block having a channel passing therethrough;

(i) said brake block channel being substantially rectangular in cross-section with a wide dimension and a narrow dimension defining first and second, opposite, wide inner surfaces;

(ii) said channel having a first end and a second end and being sufficiently large to permit a doubled portion of said strap to pass therethrough, with said strap first side being generally parallel to, and in overlapping alignment with, said channel wide inner surfaces;

(iii) said strap loop being extended through said channel so that said loop extends outwardly from said first end of said block channel and so that said first and second ends of said strap extend from said second end of said block channel, with said strap first side facing, and generally overlapping, said block channel wide inner surfaces as said strap twice passes through said channel;

(e) a friction ring in engagement with said loop; said friction ring having two opposite sidewalls, top and bottom opposite endwalls and a gate;

(i) said top end wall being elongate and substantially longer than said brake block channel is wide in its wide dimension and having a diameter larger than said narrow dimension;

(ii) said friction ring being mounted on said strap loop with said strap passing therethrough and with said ring top end aligned generally along said brake block channel wide dimension, so that diverging tension on said first and second ends of said strap tends to pull said ring and said block toward one another and generally frictionally contact and bite a portion of said strap therebetween;

(iii) a gate being in one of said sidewalls to open and close said ring and facilitate engagement between said ring and said strap, and also between said ring and other objects;

(iv) each of said sidewalls having a bore therein, said bores being oppositely spaced and coaxial with one another; and (f) a pin removably mounted in said ring; said pin being an elongate rod having a first end and a second end;

(i) said pin first end having a pivotable-key lock mounted thereon;

(ii) said pin second end having a head and a spring associated therewith;

(iii) said pin extending between and through said bores with said pin first and second ends extending outwardly therefrom and with said pin extending between said sidewalls and across said ring; said key-lock on said first end being adjustable to prevent undesired removal of said pin from said ring; said head and spring causing selective retention of said key in a locking engagement to prevent unintended opening of said key-lock;

(g) whereby said strap may be trapped between said ring top end and said brake block along said block channel first end; and further said strap may be trapped by said ring top end extending in a direction generally laterally across said channel wide dimension; and (h) whereby, for a first mode of operation, said assembly is prepared for use by: anchoring said strap first end near said place of height and extending said strap second end downwardly therefrom and sliding said block and ring along said strap to a position accessible by said descending person; and in use in said first mode, said assembly is used by securing said person to be lowered to said ring; and having said person slide down said strap by said ring, the rate of descent being controlled by forces tending to generate friction between said strap and each of said ring and block, said friction tending to slow or brake said descent;

(i) said frction being selectively increasable by partially wrapping said strap about said pin; and (i) whereby, for a second mode of operation, said assembly is prepared for use by: attaching said ring to said place of height, sliding said block into a position substantially near said ring, and adjusting said strap to have said strap first end accessible to said person descending; and in use in said second mode, said person being attached to said strap first end and being lowered thereby, with the rate of descent being controlled by forces tending to cause frictional interaction among said strap, said block, and said ring, said friction permitting controlled movement of said strap through said ring;

(i) said friction being selectively increasable by partially wrapping said strap about said pin.

5. The descent control device according to claim 4 including:

(a) spacers mounted about said second end of said brake block channel;

(i) said brake block being invertible: by removing said ring from said loop, inverting said block; and, replacing said ring; to position said block channel second end in place of said block channel first end;

(ii) said spacers, upon inversion of said brake block, selectively preventing extensive biting, or abutting, engagement between said ring and said block;

(b) whereby said device is selectively usable for relatively rapid descent, with said brake block inverted, and for slower, more controlled descent, with said brake block in a non-inverted position.

6. The descent control device according to claim 4 wherein:

(a) said brake block comprises two separate blocks, each having a channel therethrough; said blocks being aligned in sequence with said channels coaxially aligned.

7. A kit for assembling a descent control device, said kit comprising:

(a) an elongate strap having a first end, a second end, and a generally rectangular cross section, with first and second opposite, flat, sides and with first and second opposite edges;

(b) first and second attachment members associated with said strap ends;

(i) said first attachment member being a first member of a hook and eye means mounted on said strap first end;

(ii) said second attachment member being a first member of hook and eye means mounted on said strap second end;

(c) a brake block having a channel extending completely therethrough;

(i) said said channel having a generally rectangular cross-section with a wide dimension and a narrow dimension defining opposite first and second wide inner channel surfaces and opposite first and second narrow inner channel surfaces; and, said channel being sufficiently large to accomodate a doubled portion of said strap extending therethrough; with said strap first side facing and generally overlapping said channel inner wide surfaces, as said strap twice passes through said channel; and (d) a friction ring;

(i) said friction ring having an elongate top end substantially larger than said channel first end and a diameter larger than said narrow dimension, so that said ring cannot pass through said channel when said top end is aligned along said channel wide dimension; and (ii) said ring having an outer circumferential portion defining an internal volume sufficiently large for said strap to pass therethrough.

* * * * *